United States Patent [19]

O'Neill et al.

[11] 3,968,795

[45] July 13, 1976

[54] UNDERWATER BREATHING APPARATUS

[75] Inventors: Wilbur J. O'Neill, W. Severna Park; John R. Colston, Annapolis, both of Md.

[73] Assignee: Westinghouse Electric Corporation, Pittsburgh, Pa.

[22] Filed: Dec. 11, 1974

[21] Appl. No.: 531,849

[52] U.S. Cl. ..... 128/142.3; 251/61.4; 137/494

[51] Int. Cl.[2] ..... A62B 7/00

[58] Field of Search ..... 128/142.3, 142.2, 142, 128/145.8, 145.6, 145.5, 142.7, 204, 30, 191 A; 251/61.4, 336; 137/494

[56] References Cited

UNITED STATES PATENTS

| | | | |
|---|---|---|---|
| 3,370,585 | 2/1968 | O'Neill | 128/142.2 |
| 3,402,711 | 9/1968 | Emerson | 128/142.2 |
| 3,465,752 | 9/1969 | Brychta et al. | 128/145.8 |
| 3,508,542 | 4/1970 | Browner | 128/142.2 |
| 3,509,899 | 5/1970 | Hewson | 137/624.14 |
| 3,526,239 | 9/1970 | Oroza | 128/142.2 |
| 3,802,427 | 4/1974 | Banjavich et al. | 128/142.3 |
| 3,841,348 | 10/1974 | O'Neill | 137/494 |
| 3,859,994 | 1/1975 | Almqvist et al. | 128/142.3 |
| 3,877,425 | 4/1975 | O'Neill | 128/142 |
| 3,881,480 | 5/1975 | Lafourcade | 128/145.8 |

*Primary Examiner*—Robert W. Michell
*Assistant Examiner*—Henry J. Recla
*Attorney, Agent, or Firm*—D. Schron

[57] ABSTRACT

Breathing gas from a remote source is supplied directly to a diver's helmet, without the requirement of a demand valve. Exhaust gas is returned back to the remote source through a series arrangement of a normally open fail-safe valve and an exhaust control valve which maintains the helmet pressure within predetermined limits relative to the ambient water pressure. Should the exhaust control valve fail in the open position, the fail-safe valve will actuate to insure that the helmet pressure does not decrease to a dangerous level. Valve actuation is a function of diver orientation so as to maintain helmet pressure within a range to minimize diver breathing effort, for the various positional orientations.

The helmet includes ducting for the exhaust gas and the valves are constructed and arranged to sense the helmet pressure directly for comparison with the ambient water pressure acting on the respective valves.

13 Claims, 21 Drawing Figures

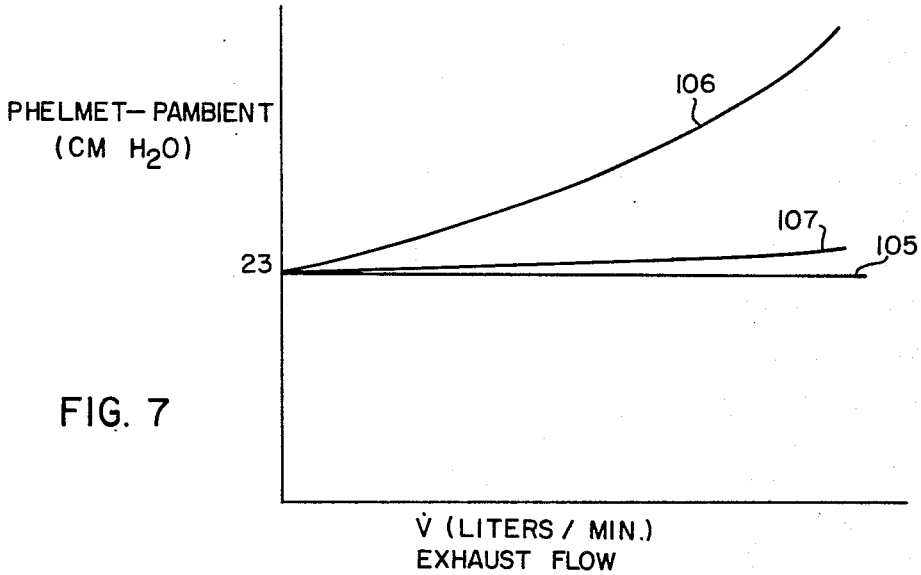
FIG. 7
FIG. 9
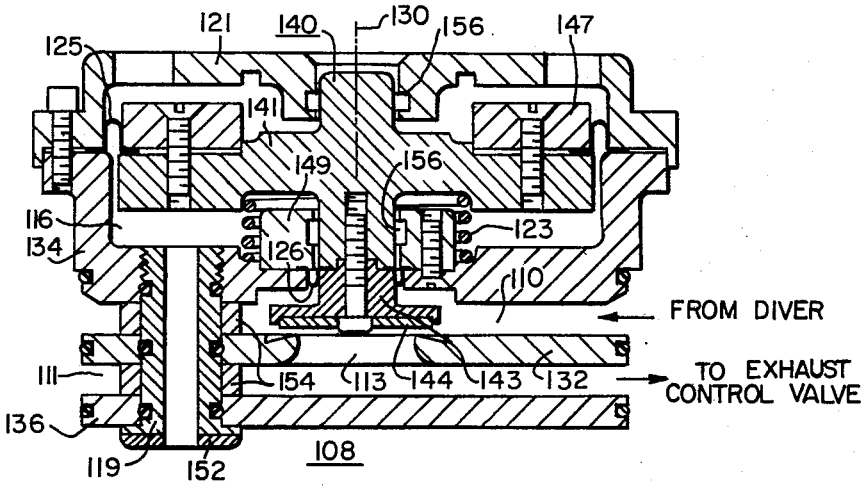
FIG. 10
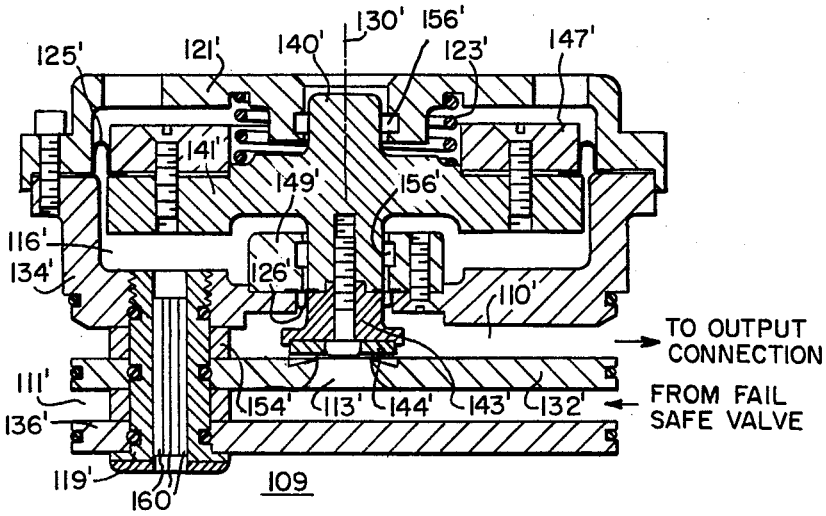

UNDERWATER BREATHING APPARATUS

CROSS-REFERENCE TO RELATED APPLICATIONS

This application is related in subject matter to copending applications Ser. No. 531,845 filed concurrently herewith, Ser. Nos. 306,944 now U.S. Pat. No. 3,272,258 and 306,945 now abandoned, filed Nov. 15, 1972, all assigned to the same assignee as the present invention.

BACKGROUND OF THE INVENTION

1. Field of the Invention

The invention in general relates to diver underwater breathing apparatus, and particularly to such apparatus supplied with breathing gas from a remote source.

2. Description of the Prior Art

In a "push-pull" type breathing apparatus system, the diver is supplied with breathing gas from a remote source and exhaled gas is returned to the source for $CO_2$ removal and oxygen replenishment. This type of system increases diver safety and productivity by eliminating the burden and possible danger inherent in closed-circuit back-worn apparatus. The push-pull mode of operation allows the changing of $CO_2$ absorbent canisters at the source without interrupting the diver's work, and a single atmosphere control system will suffice for several divers supplied from the source.

The duration of a single dive is limited solely by diver endurance rather than by equipment limitations, and check-out time is minimal due to the lack of sensors, electronics, power supply, regulators, pressures, etc. that have to be checked out in other types of equipment.

One type of push-pull arrangement proposed in the past supplied the diving mask of the diver with breathing gas and a return hose from the mask conducted exhaust gas back to the source. This proposed apparatus would not allow the diver to make significant excursions above or below the level of the remote source. Another arrangement, such as described in U.S. Pat. No. 3,370,585, included an inhalation valve and an exhalation valve in conjunction with breathing bags to remedy the deficiencies of the mask proposal.

The present invention allows for a push-pull type of operation wherein the requirement for an inlet demand valve may, if desired, be eliminated as well as the requirement for breathing bags without the sacrifice of high safety standards.

SUMMARY OF THE INVENTION

The present invention provides diver-worn headgear including an input connection for receiving gas at headgear pressure from a remote source and an output connection for returning exhaust gas back to the source. Breathing gas from the input connection is provided directly to the interior space between the headgear and wearer.

An exhaust flow path is connected to the output connection and includes a normally open fail-safe valve and an exhaust control valve in series arrangement with each of the valves including three chambers or compartments. The flow path for the exhaust gas includes a first duct which communicates the interior space between the headgear and the wearer with a compartment of the fail-safe valve, with another compartment thereof being communicative with a compartment of the exhaust control valve. Another compartment of the exhaust control valve in the flow path is connected to the output connection. The third compartment of each of the valves constitutes a gas pressure sensing compartment out of the flow path and in direct pressure communication with the interior space.

Since the diver may be working or swimming in various positional orientations, valve actuation is made orientation dependent so as to maintain breathing gas pressure within comfortable limits for the diver.

BRIEF DESCRIPTION OF THE DRAWINGS

FIG. 7 is a curve illustrating volumetric exhaust flow on the horizontal axis and the difference between helmet and ambient pressure on the vertical axis;

FIGS. 9 and 10 are cross-sectional views of valves which are inserted in the arrangement of FIG. 8;

DESCRIPTION OF THE PREFERRED EMBODIMENT

Figure 1:
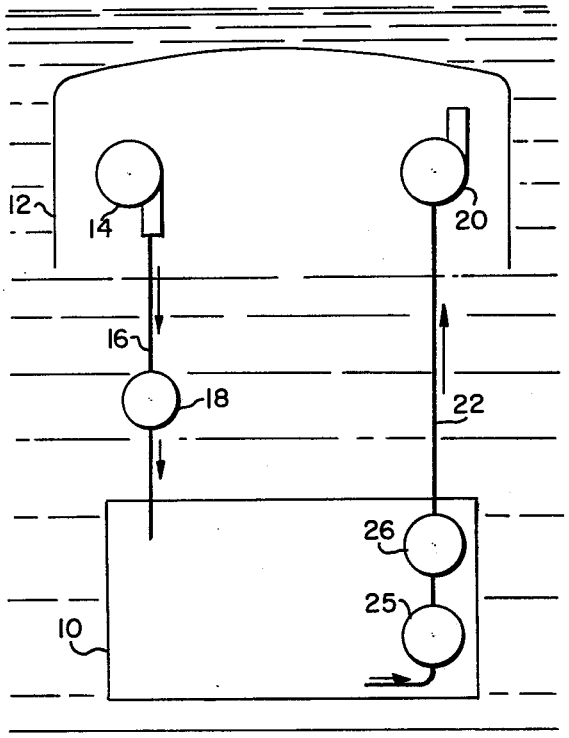
FIG. 1 is a diagrammatic representation of a push-pull breathing system arrangement.

FIG. 1 illustrates a push-pull type of system in an underwater environment. A diver-worn headgear 10 is supplied with breathing gas from a remote source 12 by means of a pump 14 and gas hose 16. In the present arrangement, the breathing gas after passing a check valve 18 is supplied directly to the headgear 10 and may, if desired, be supplied without any requirement for a demand valve. Exhaust gas is returned to the source 12 by means of a suction source 20 and gas hose 22. In the present invention, the exhaust gas prior to being returned to the source must first pass through a fail-safe valve 25 and an exhaust control valve 26 serially arranged in the gas flow circuit.

The remote source 12 may be any one of a number of different pieces of equipment, such as a diving bell, lockout submarine, or underwater habitat, to name a few. Now shown in FIG. 1 is the gas processing and control equipment for maintaining a breathing atmosphere for the diver or occupants of the remote habitat.

Figure 2A:
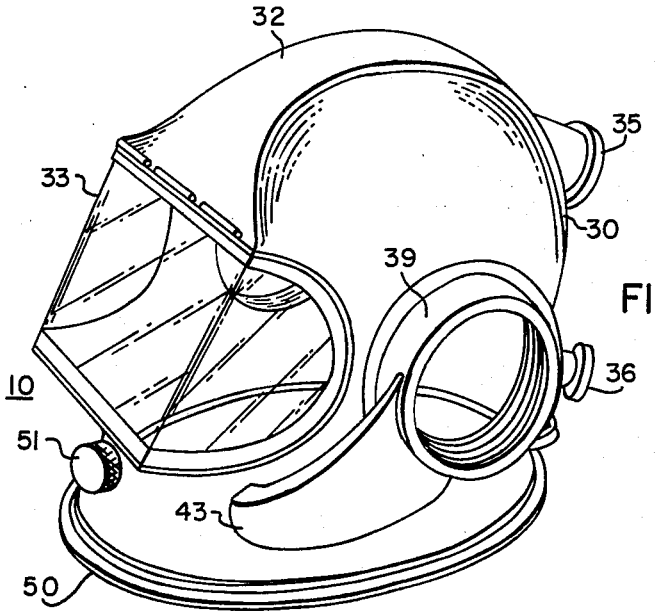
FIGS. 2A and 2B are views of a helmet which may be utilized in conjunction with the present invention.
Figure 2B:
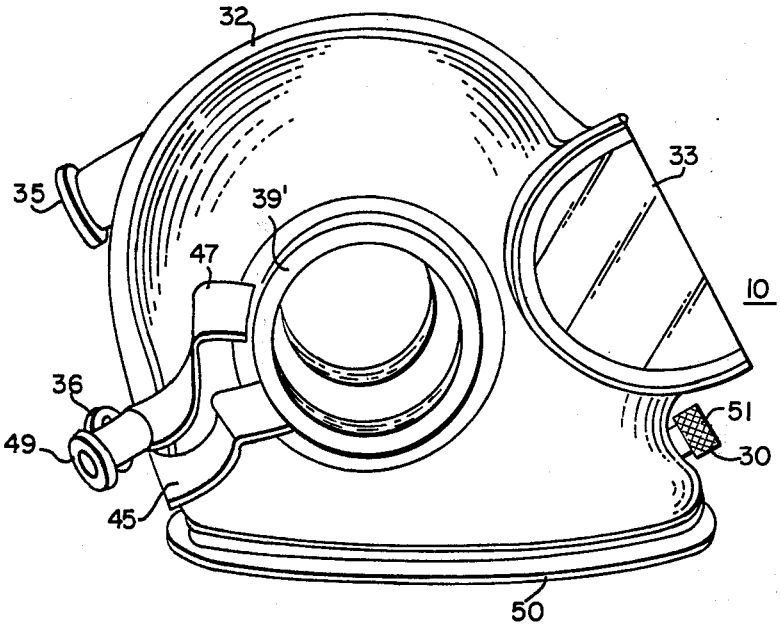

The present invention may be utilized with a variety of different diver-worn headgear; however, it will be described with respect to a diving helmet, and particularly to the diving helmet described in the aforementioned application Ser. Nos. 306,944 and 306,945. This type of helmet offers many advantages and two views of the helmet are illustrated in FIGS. 2A and 2B, with the outside insulating and protective coatings stripped away, for clarity.

The helmet 10 includes a shell 30 with a breathable gas supply passageway or duct 32 passing over the top of the shell 30 for delivering breathing gas to the interior of the helmet at a position just above the window 33. Breathing gas may be supplied to this duct 32 by one of two input connections 35 or 36. A first receiver 39 on the left side of the helmet is operable to receive the fail-safe valve and a similar receiver 39′ on the right side of the helmet is operable to receive the exhaust control valve. Exhaust gas is conducted by means of an exhaust conduit or duct 43 to the receiver 39 with the exhaust flow path additionally including a second conduit or duct 45 interconnecting the two receivers 39 and 39′, (and therefore the two valves when inserted) and a third conduit or duct 47 which communicates receiver 39′ with an output connection 49.

The base 50 of the helmet normally would include a clamping arrangement for complementary engagement with a diver-worn neck seal, not illustrated, and an overpressure valve 51 is provided for a purpose to be explained.

Figure 3:
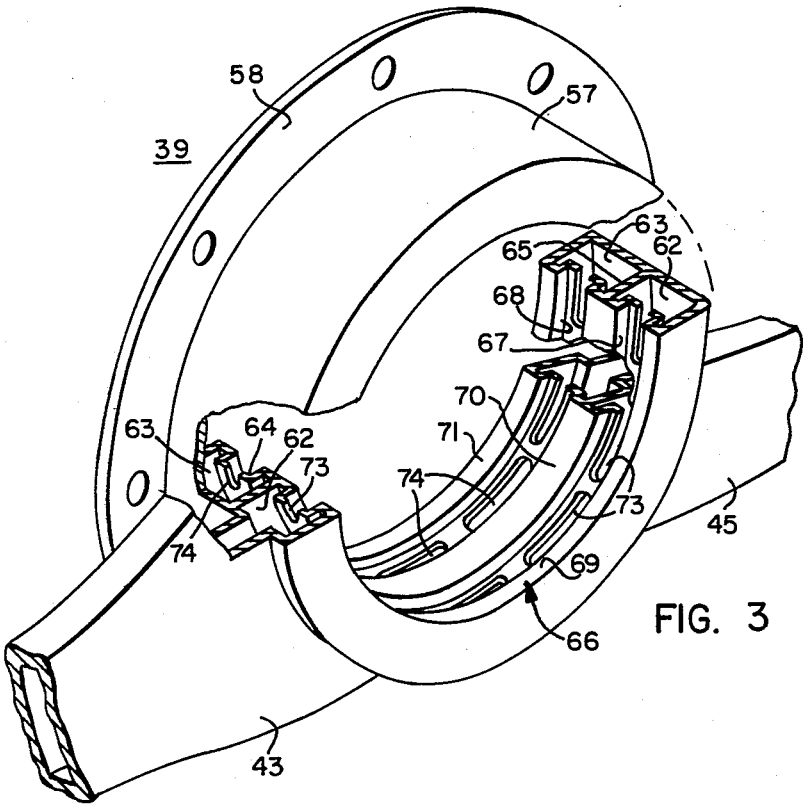
FIG. 3 is a view, with portions broken away, of a portion of the helmet illustrated in FIG. 2A.

In FIG. 3, there is illustrated in more detail, a typical receiver, the left one 39 with portions broken away to show the interior thereof. The receiver 39 has a body portion 57 and is secured to the helmet shell by means of a flange 58. The receiver 39 includes two annular plenum chambers 62 and 63 separated by a wall 65 with the plenum chamber 62 constituting the outer plenum chamber, and 63 the inner plenum chamber. The inside surface 66 has defined therein two annular grooves 67 and 68 with adjacent land areas 69, 70 and 71, with the outer grooves 67 being communicative with plenum chamber 62 by means of, for example, a plurality of annularly disposed openings 73. Annular groove 68 is, in a similar manner, communicative with the plenum chamber 63 by means of a plurality of annularly disposed openings 74.

Exhaust gas from exhaust duct 43 enters plenum chamber 62 and is free to exit therefrom via the openings 73. The other plenum chamber 63 is communicative with the interconnecting duct 45 and gas communication to it is made by way of openings 74. Receiver 39′ would have a structure similar to receiver 39.

Figure 4:
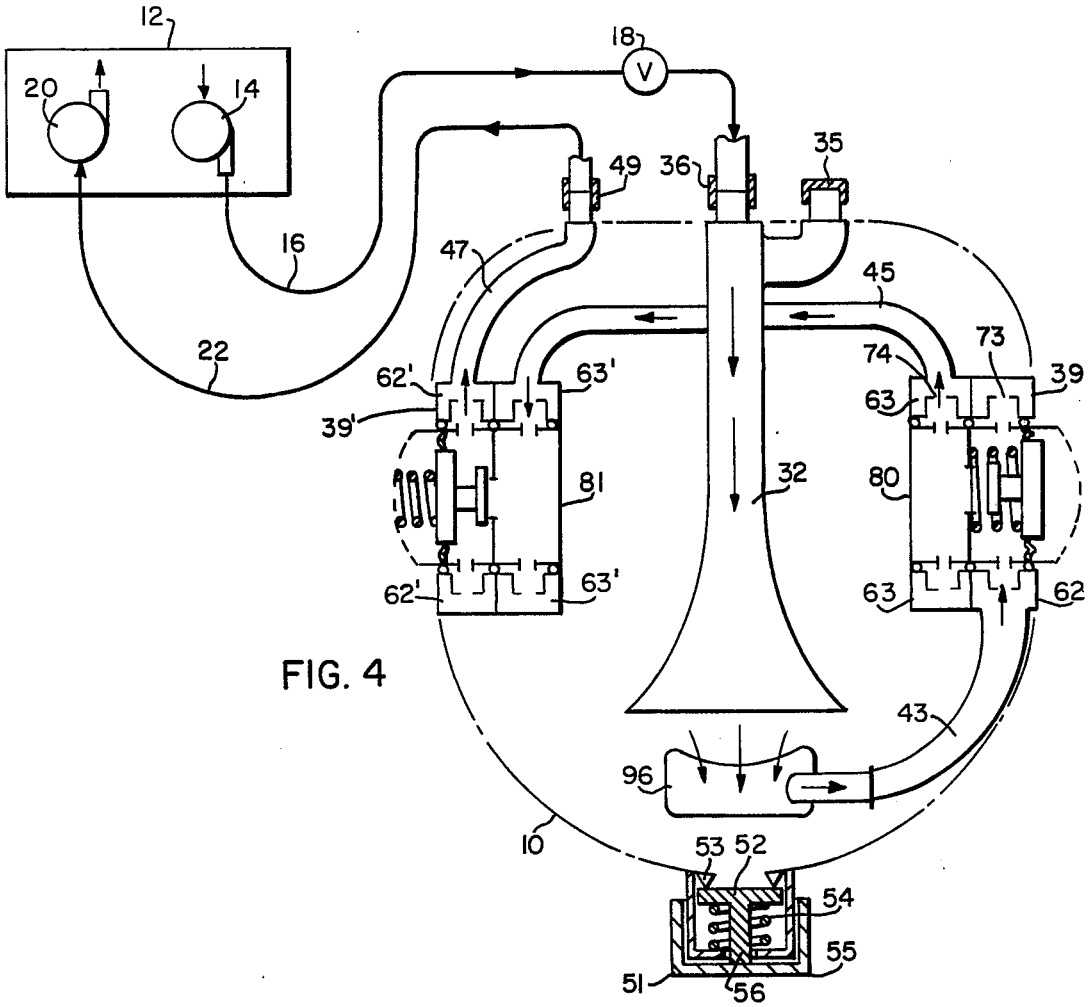
FIG. 4 is a gas circuit diagram which includes the helmet of FIG. 2A with inserted control valves.

FIG. 4 illustrates a gas circuit layout of the push-pull gas supply mode and components previously described have been given their same reference numeral. The portions of the right receiver 39′ have been given primed reference numerals corresponding to those portions of receiver 39. A fail-safe valve 80 is inserted into the receiver 39 and an exhaust control valve 81 is inserted into receiver 39′. The valves are also illustrated with reference numerals in FIGS. 4A and 4B.

Figure 4B:
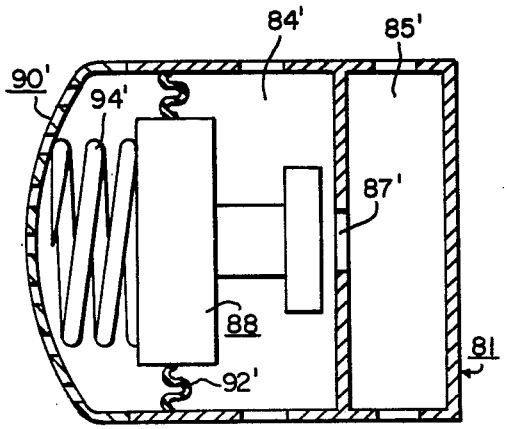
FIGS. 4A and 4B illustrate the inserted valves of FIG. 4.
Figure 4A:
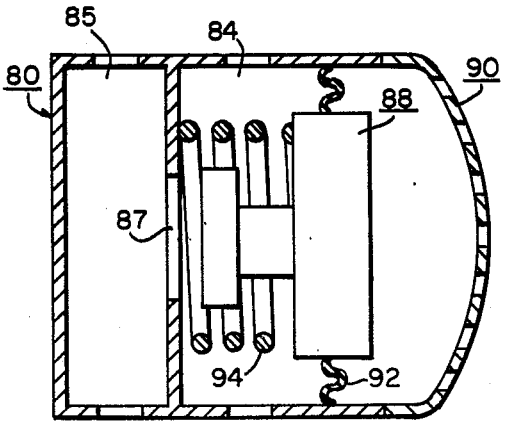

In the schematic representation of FIGS. 4, 4A and 4B the fail-safe valve 80 is seen to include a first compartment or chamber 84 which is communicative with plenum chamber 62, and a second chamber 85 communicative with plenum chamber 63. The chambers are separated by an aperture 87 which is closable by means of valve actuator 88. An apertured cap 90 allows ambient water pressure to act on the valve actuator 88 while watertight integrity is maintained by means of the flexible diaphragm 92. In normal operation, ambient water pressure acting on the valve actuator 88 tending to close the aperture 87 is opposed by means of a spring 94 and the gas pressure within chamber 84. In the absence of a failure of exhaust control valve 81, aperture 87 would normally remain in an open condition so that there is gas communication between exhaust duct 43 and the interconnecting duct 45 by way of plenum chamber 62, chamber 84, aperture 87, chamber 85, and plenum chamber 63.

The exhaust control valve 81 is very similar to the fail-safe valve 80 and the components thereof have been given similar primed reference numerals. Basically, there are two differences between the valves, one difference being the smaller sized aperture 87′ for the exhaust control valve and the positioning of spring 94′ which operates in a manner tending to aid the water pressure in moving the actuator 88 to close off the aperture 87′ between the valve compartments.

Exhaust gas may be provided to exhaust duct 43 by means of a collector 96 or by an oral-nasal mask, for example. The exhaust flow path therefore includes the serial arrangement of fail-safe valve 80 and exhaust control valve 81 with the exhaust flow path being connected to the output connection 49 for conduction of exhaust gas back to the habitat or source 12.

The spring force or setting of spring 94′ of the exhaust control valve 81 is set to a value so as to maintain the helmet system pressure within predetermined limits relative to the ambient water pressure at the valve, more particularly, at the level of the center of the valve diaphragm. Should the exhaust control valve fail in an open position, there is a danger of system pressure within the helmet falling to a dangerously low value, which would place the diver's life in jeopardy. The fail-safe valve 80 is designed to close when the dangerously low pressure limits are reached so as to cut off any exhaust flow. The pressure within the helmet will then rise to a safe value determined by the overpressure valve 51 so that the diver may return to the safety of the habitat. The overpressure valve 51 includes a disk 52 which bears against seal edge 53 by action of spring 54. A knob 55 connected to disk 52 by means of a stem 56 is provided for manual activation so that the overpressure valve 53 may also be utilized as a dewatering valve for removing any water within the helmet. This may be accomplished by manually closing the exhaust control valve which causes an increase in helmet pressure. If the valve 51 is at a low point, any water will be driven out.

During an underwater excursion, it is desirable that the pressure of the gas being breathed by the diver be equal to the hydrostatic pressure acting on the diver's body at a certain reference point. When supplied with gas at that pressure, the effort required by the diver to breathe is minimized. If the exhaust control valve 81 were an ordinary spring-loaded valve, the spring force could be set so that valve actuation would occur when the breathing gas pressure was equal to the pressure level at a predetermined distance hydrostatically lower than the valve location. The diver would then experience comfortable breathing. However, with that fixed setting, there is a possibility of uncomfortable breathing gas pressures for various other diver orientations. Accordingly, valve actuation is made orientation dependent so as to maintain breathing gas pressure within comfortable limits. This is accomplished by a weight which aids or opposes the spring force in accordance with the valve's positional orientation. The weight in the exhaust control valve 81 is incorporated into the massive valve actuator 88. This type of valve is described in U.S. Pat. No. 3,841,348.

Figure 5A:
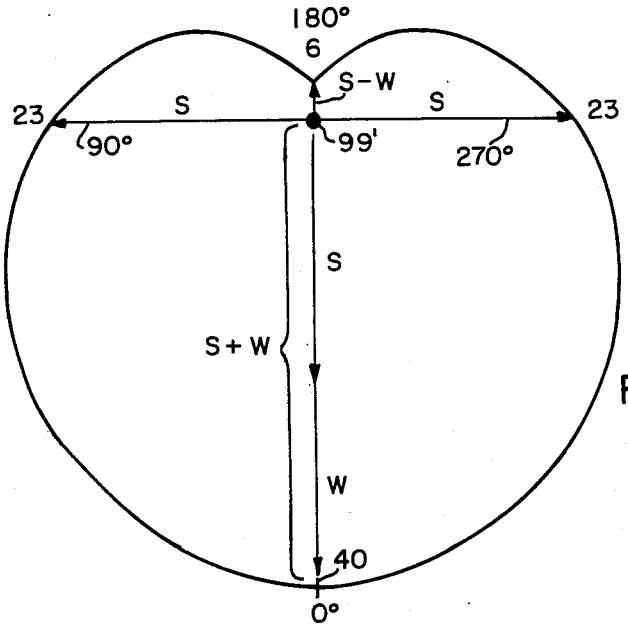
FIGS. 5A and 5B are polar plots of closing pressure vs angular orientation for the inserted valves of FIG. 4.

Basically, and with additional reference to FIG. 5A, the spring and weight cooperate to vary the closing force of the valve actuator as illustrated by the cardioid shape curve. Assuming the valve location at point 99', and with the valve in an upright condition (such that aperture 87' would lie on a horizontal plane,) it is seen that at the 0° orientation, the closing pressure S+W would be that contributed by both the weight (W) and the spring (S), while at the opposite 180° orientation, the closing pressure would be the difference in contribution of the spring and weight S-W. At the 90° or 270°orientation, the closing pressure is just that contributed by the spring, and in general, for any orientation $\theta$ the pressure maintained would be equal to S+W(cos $\theta$) greater than the ambient water pressure acting at the level of the valve center. For example, if the pressure contributed by the spring was equivalent to 23 centimeters of water and that of the weight equivalent to 17 centimeters of water, the closing pressure for the 0°, 90°, 180° and 270° orientations would be 40, 23, 6 and 23 centimeters of water, respectively.

Figure 5B:
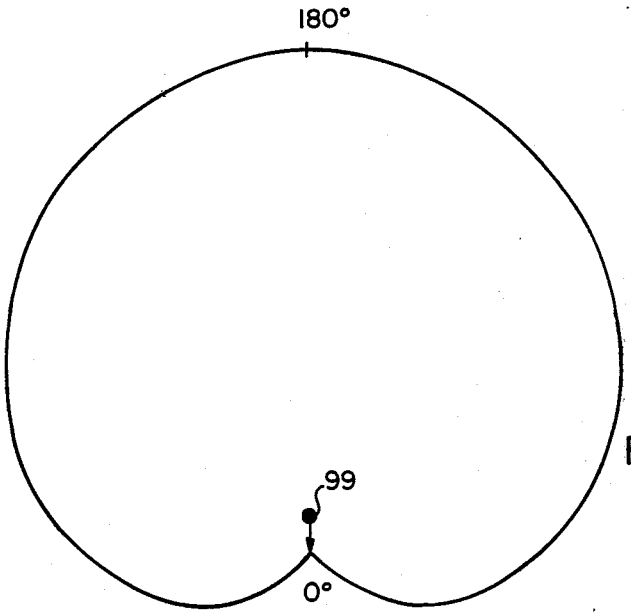

The exhaust control valve 81 is designed to actuate at certain pressures greater than the pressure at the depth of the valve and FIG. 5A illustrates the loci of closing pressures for different valve orientations. The fail-safe valve 80 is of a particular design so that actuation will occur at certain pressures less than the pressure at the depth of the valve. FIG. 5B illustrates the loci of closing pressures for the fail-safe valve 80 for a similar orientation as the exhaust control valve 81.

Figure 6A:
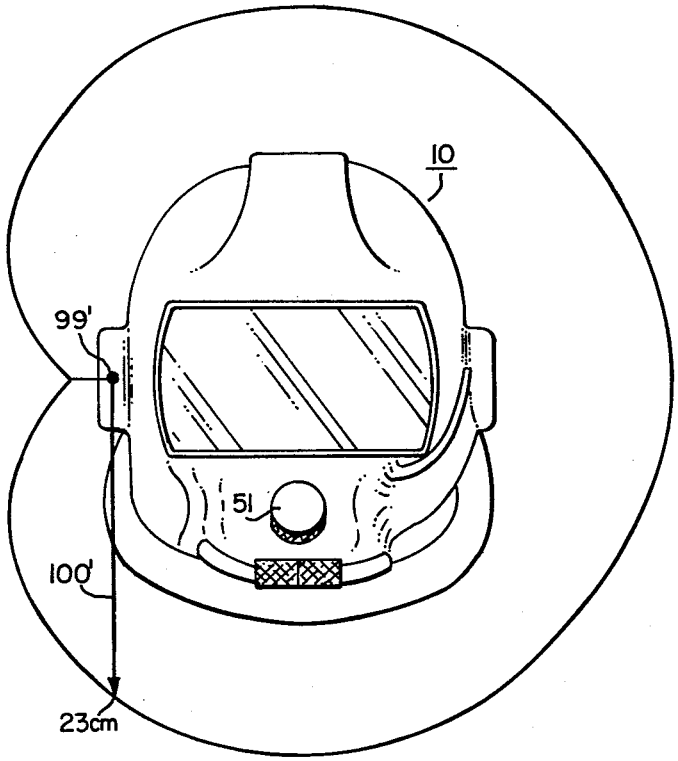
FIGS. 6A and 6B illustrate the polar plots with their orientations to the diving helmet with inserted valves.
Figure 6B:
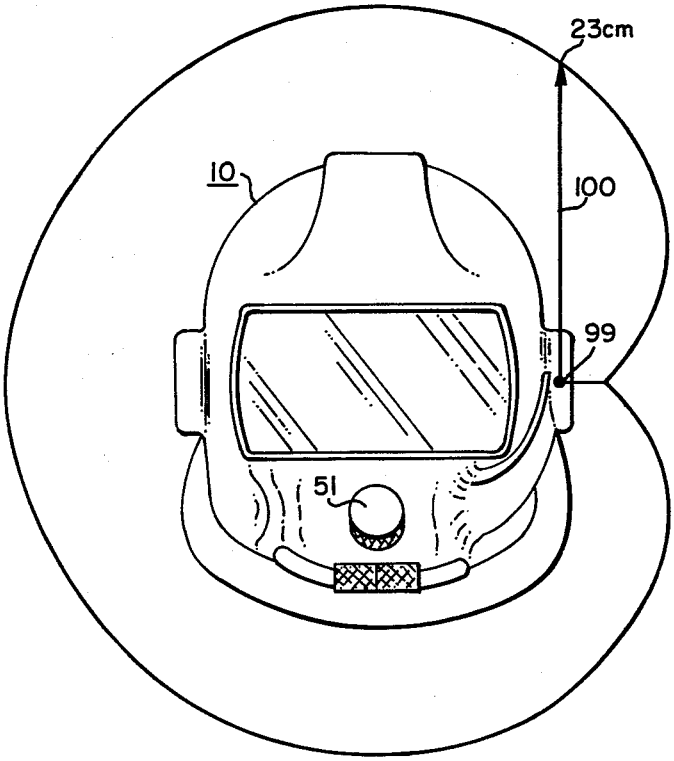

The curve of FIG. 5B is the reverse of that illustrated in 5A. For the valve insertion and orientation illustrated in FIG. 4, the relative closing pressure curves of FIGS. 5A and 5B would be tipped on their sides to form a composite or blended loci, whereby an actuation point of the exhaust control valve occurs at the greatest pressure embraced by the blended loci and a second actuation point occurs for the fail-safe valve at the least pressure embraced by the blended loci. FIG. 6A illustrates a frontal view of the helmet 10 with the curve of FIG. 5A superimposed thereon so that point 99' is at the center of the inserted exhaust control valve. Blended with this curve, however illustrated in FIG. 6B for clarity, would be the curve of FIG. 5B with point 99 located at the center of the inserted fail-safe valve. During the breathing cycle, the breathing gas pressure within the helmet increases and decreases. Conceptually, the breathing gas pressure level may be correlated with an imaginary horizontal plane which moves up toward the valve during inhalation and down away from the valve during exhalation. Arrow 100' represents a vertical orientation line and when the pressure level increases (the imaginary plane travelling downward), the exhaust control valve will open when the pressure level hits the superimposed curve at the point where the orientation line touches it. That is, for FIG. 6A, exhaust control valve 81 will open when the breathing gas pressure is 23 centimeters of water greater than the ambient pressure at the valve. For other diver orientations the valve will open when the breathing system pressure is greater than the ambient pressure at the valve by an amount defined by the S+W(cos $\theta$) relationship.

In normal operation the fail-safe valve will always remain in an open condition. If, however, the exhaust control valve fails in an open position, the breathing gas pressure level will decrease, that is the imaginary horizontal pressure plane will move toward the water surface, thus presenting an extremely dangerous condition to the diver. With the present arrangement, however, as the pressure plane moves toward the surface, valve actuation of the fail-safe valve will occur when the pressure level hits the curve where the vertical arrow 100 intersects it, in FIG. 6B. In the present example, therefore, the fail-safe valve will close, for the particular diver orientation illustrated, when the breathing gas pressure is 23 centimeters of water less than the ambient water pressure at the fail-safe valve. For other diver orientations, the fail-safe valve will actuate to a closed position when the breathing gas pressure within the helmet is less than the ambient water pressure at the fail-safe valve by an amount defined by S−W(cos $\theta$). Upon actuation of the fail-safe valve, the helmet pressure will increase to a level determined by the setting of the overpressure valve 51 until the defect can be remedied.

Ideally, the exhaust control valve will actuate with the same pressure differential between helmet pressure and ambient pressure at the valve, regardless of exhaust gas volumetric flow rate or gas density. This ideal situation is illustrated by horizontal curve 105 in FIG. 7 wherein the pressure difference is plotted on the vertical axis and the volumetric flow rate of the exhaust gas is plotted on the horizontal axis. Curve 105 illustrates that for any volumetric flow rate, the difference in helmet pressure over ambient pressure will always remain constant. In actuality, however, the pressure differential does not remain constant, but may be more like the curve 106 which illustrates that as the volumetric flow rate increases, the pressure differential also increases, thus requiring a greater helmet pressure for valve actuation. The curve slope would also increase with increased gas density. This is due to the fact that the arrangement illustrated in FIG. 4 includes various ducts or conduits, and there is a substantial pressure drop in the ducting to cause the undesired variation. To obviate this, the valves are preferably made to respond to the helmet pressure as opposed to the duct pressure so as to provide operation as defined by curve 107 of FIG. 7, very close to the ideal.

Figure 8:
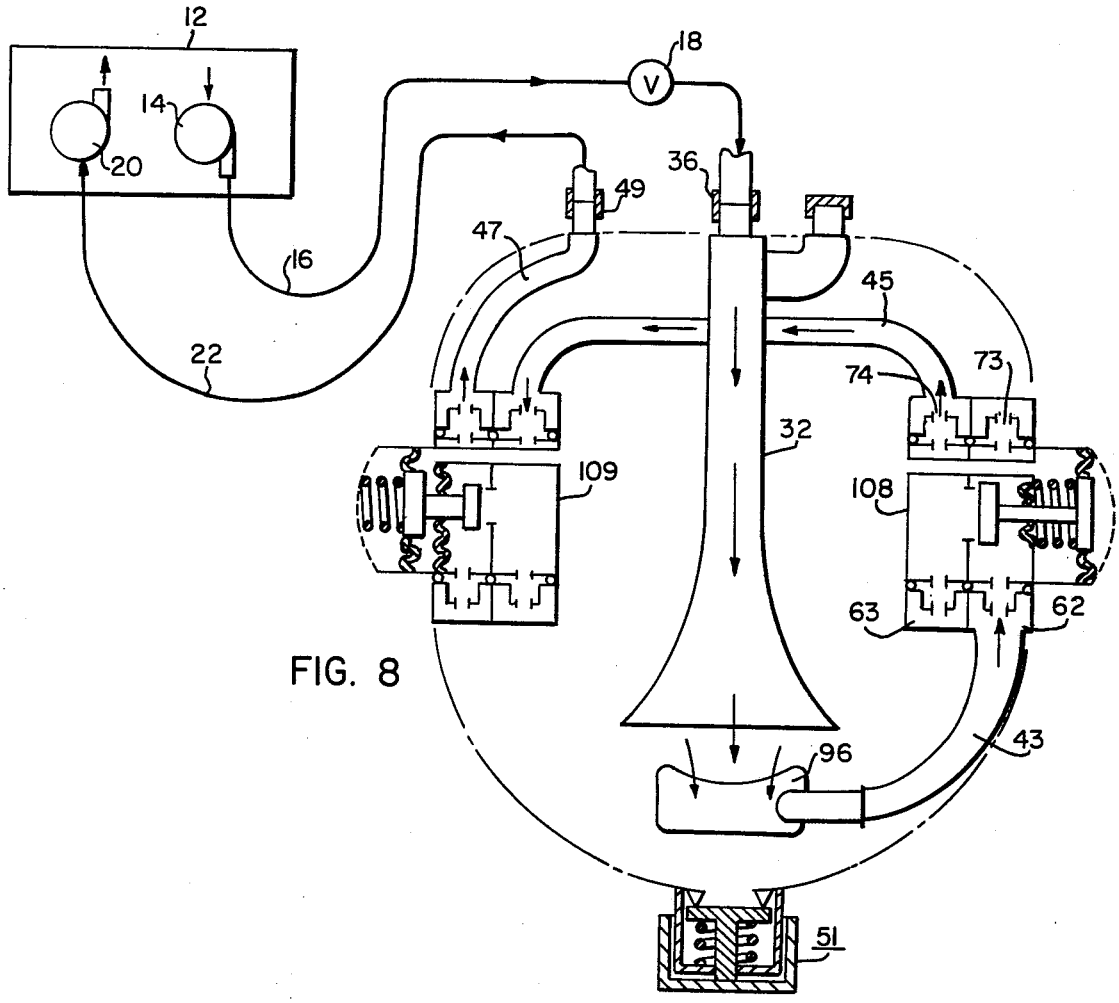
FIG. 8 is a view similar to FIG. 4 with different inserted valves.
Figure 8A:
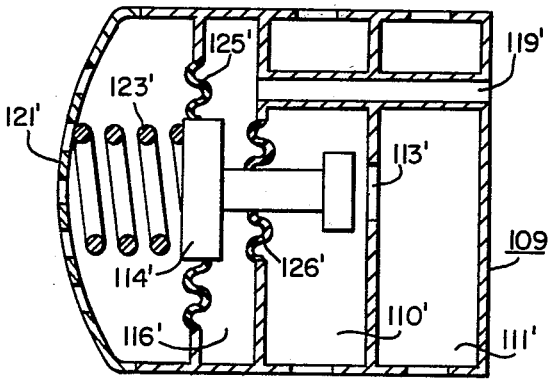
FIGS. 8A and 8B illustrate the inserted valves of FIG. 8.
Figure 8B:
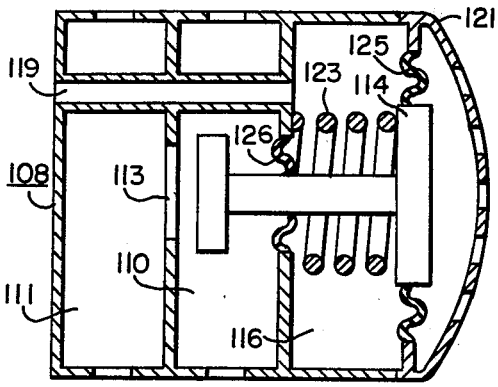

This is schematically illustrated by the arrangement of FIG. 8 which is a duplication of FIG. 4 with the same reference numerals, except for the different inserted fail-safe valve 108 and exhaust control valve 109 also illustrated with reference numerals in FIGS. 8A and 8B. Valve 108 includes first and second compartments or chambers 110 and 111 with gas communication between them being provided by aperture 113 which is closable by means of movable actuator 114. The valve additionally includes a third chamber 116 which is sealed off from the exhaust flow path between chambers 110 and 111, but which is in direct pressure communication with the inside of the helmet by a pressure communication means, such as tube 119.

An apertured cap 121 allows the ambient water pressure to bear directly against the outside surface of the actuator 114, and this ambient water pressure is opposed by the pressure in chambers 110 and 116 and by the action of spring 123.

Flexible diaphragms 125 and 126 provide for separation of chamber 116 from the ambient water medium and from chamber 110, respectively.

Exhaust control valve 109 is similar to fail-safe valve 108, and has been given similar primed reference numerals. As was the case with respect to FIG. 4, the aperture 113' of the exhaust control valve is somewhat smaller than the aperture of the fail-safe valve, and the spring 123' has been put into a position to tend to close the valve actuator 114'. In addition, both valve actuators 114 and 114' are preferably weighted so that valve actuation is diver orientation dependent, as previously described.

It is thus seen that the exhaust flow path between the collector 96 and output connection 49 includes the serial arrangement of exhaust duct 43, chambers 110 and 111 of fail-safe valve 108, interconnecting duct 45, chambers 111' and 110' of exhaust control valve 109, and duct 47. It is seen that the third compartment or chamber 116 of fail-safe valve 108 and 116' of exhaust control valve 109 constitute gas pressure sensing compartments out of the exhaust flow path and in direct pressure communication with the interior of the helmet.

FIG. 8 schematically illustrated the basic parts of the fail-safe and exhaust control valve structure. FIGS. 9 and 10 illustrate an actual valve construction for the fail-safe and exhaust control valve, respectively. FIG. 9 is a cross-sectional view taken along a central axis 130. Component parts previously described in the schematic representation of the valve have been given the same reference numerals in FIG. 9. The first chamber 110 which receives exhaust gas from plenum chamber 62 (FIG. 8) is defined by a nozzle plate 132 and a valve housing 134. The second chamber 111 communicative with plenum chamber 63, is defined by the nozzle plate 132 and an end plate 136.

Aperture 113 in nozzle plate 132 is closable by the movable actuator 140 which in itself is made up of a plurality of parts including a piston member 141 to which is connected a flapper base 143 which holds a rubber flapper 144 for effecting a seal with the nozzle plate 132.

An annular retainer member 147 secures, in conjunction with the piston 141, one peripheral portion of a diaphragm 125, the other peripheral portion of which is secured between the valve housing 134 and the apertured cap 121. A second retainer 149, in conjunction with the valve housing 134, secures one peripheral portion of the other diaphragm 126, the other peripheral portion of which is secured between the piston 141 and flapper base 143, and thus the third compartment or chamber 116 of the valve is defined.

The pressure communication means which communicates the helmet interior directly with the third chamber 116 takes the form of a vent screw which passes through end plate 136, nozzle plate 132 and valve housing 134. A plurality, for example three, of the vent screws 119 may be evenly positioned around the axis 130. The notch 152 for the vent screw serves the purpose of not only enabling proper insertion of the item but will additionally form a pressure communication path should a portion of the diver's underliner which may be worn, rest up against the bottom of the valve. If this should occur, pressure communication with the helmet interior would still be maintained.

The plate and housing are separated from one another by means of spacers 154 and the valve includes numerous O rings, as illustrated, in addition to wear rings 156.

Spring 123 tending to maintain the valve in an open position bears against the underside of piston 141 and against the valve housing 134. The piston 141, retainer 147, and flapper base 143 are of a precalculated weight so that valve actuation is orientation dependent, as previously described.

FIG. 10 illustrates the exhaust control valve 109 which is similar to the fail-safe valve 108, except for the smaller size of aperture 113', and placement of the spring 123'.

During normal operation, the fail-safe valve remains in an open condition, while the exhaust control valve is continually opening and closing to maintain system pressure. In order to prevent oscillation of the valve moving parts, the vent screw 119' includes a plurality of small tubes 160 within the central passage of the vent screw and which act as damping tubes.

Figure 11:
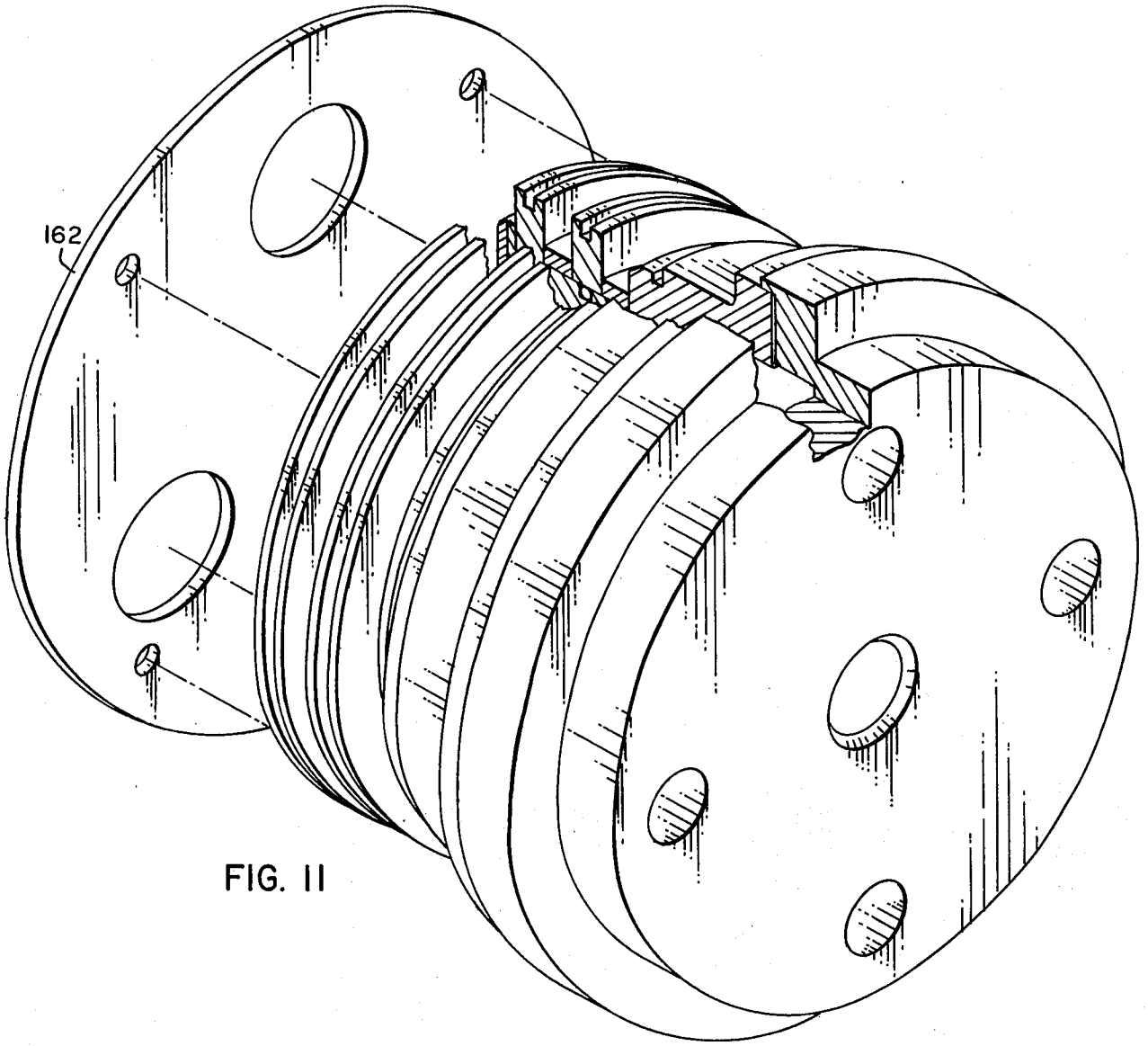
FIG. 11 is an isometric view of the valve of FIG. 9.

FIG. 11 is an isometric view of a typical valve, for example the fail-safe valve, in its orientation to be inserted into the left receiver of the helmet. After insertion into the receiver, a securing plate 162 is connected to the valve from the inside of the helmet so as to secure the valve into position.

The fail-safe valve construction of FIG. 9 is such that upon occurrence of a failure of the exhaust control valve in an open position, the fail-safe valve will close when the pressure level becomes less than predetermined limits. Should the exhaust control valve failure be temporary and accordingly thereafter operate properly, the fail-safe valve will resume its normally open position. As an alternative, the fail-safe valve may be designed, by enlarging the flapper 144 and aperture 113, to operate such that upon any failure of the exhaust control valve, the fail-safe valve will close and will remain closed so that the diver must return to the underwater habitat to remedy the condition which caused an exhaust control valve failure, whether temporary or not.

Figure 12A:
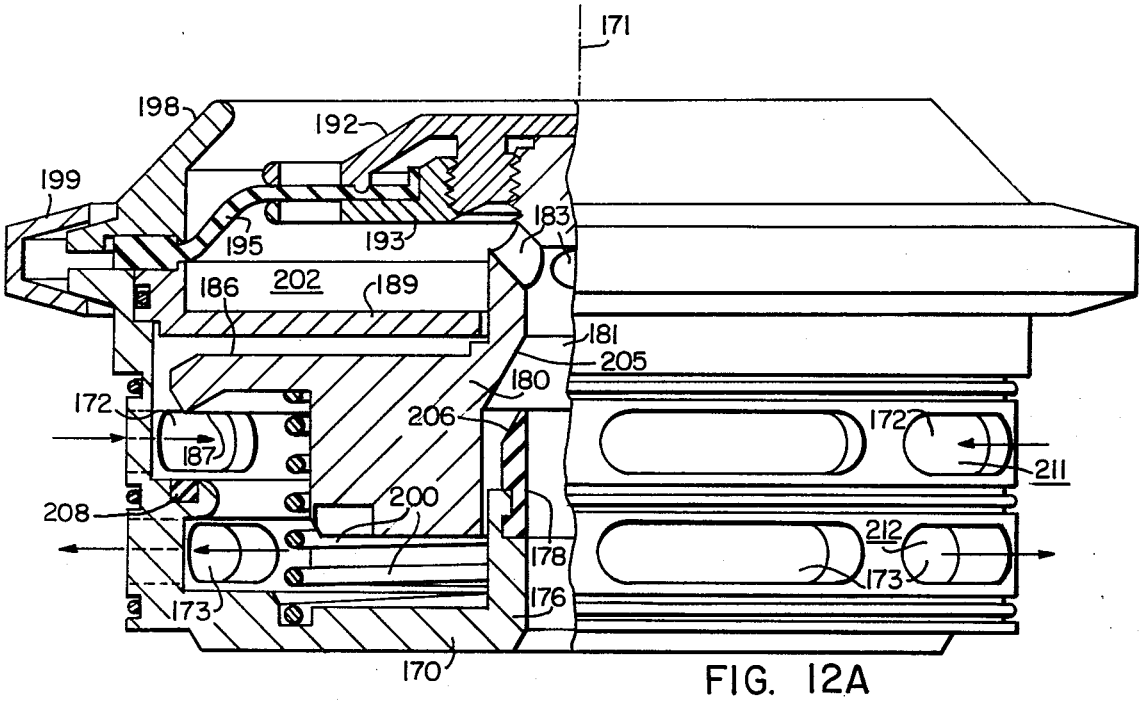
FIGS. 12A and 12B are cross-sectional views of an alternate valve in respectively open and closed positions.

An example of a variation of this type of fail-safe valve is illustrated in partial cross-section in FIG. 12A illustrating an open position, and 12B illustrating a closed position. Referring now to FIG. 12A, the valve includes a valve body 170 symmetrically disposed about a central axis 171 and including a plurality of apertures 172 into which enters exhaust gas via plenum chamber 62. A second plurality of apertures 173 allows exiting of exhaust gas into plenum chamber 63.

The valve body 170 has a central upstanding cylindrical portion 176 to which is connected a seal member 178.

Axially movable within the valve body 170 is a weight 180 having a central passage 181 and a plurality of apertures 183 near the upper portion thereof. The weight member 180 additionally has a flange portion 186 the lower part of which forms a sharp edge 187.

Figure 12B:
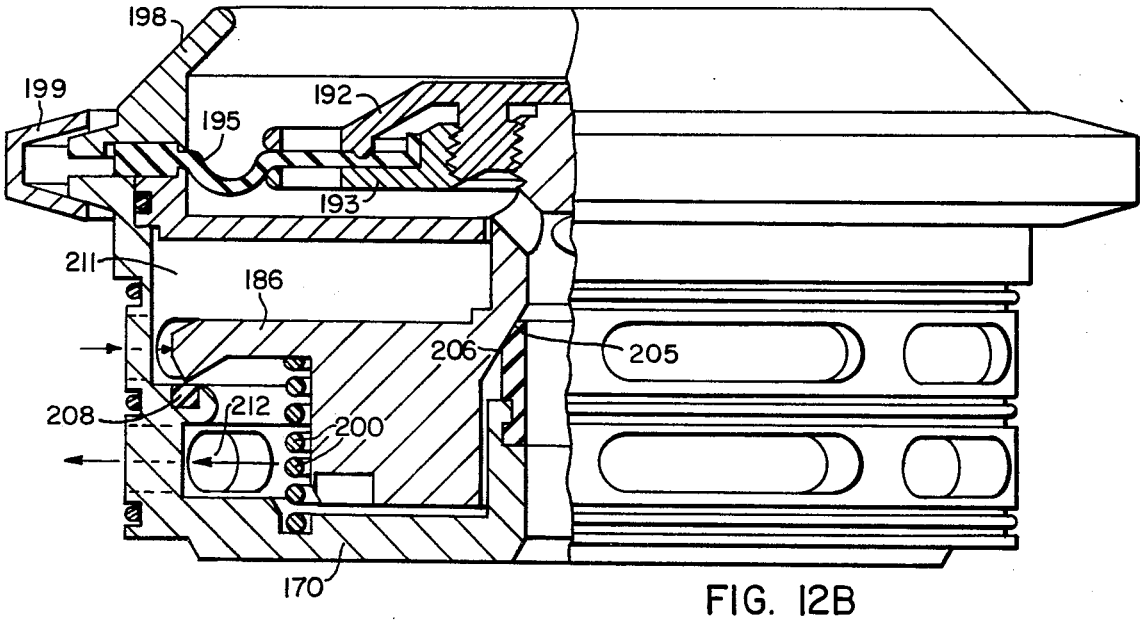

The weight 180 is maintained in the position by means of a guide 189 and secured to, and movable with, the weight 180 is a manual activation button 192 and diaphragm nut 193 which contain the diaphragm 195. The other end of the diaphragm is retained in its position by means of a cap 198 held in position relative to the valve body 170 by means of a clamp 199. A spring 200 bears against the undersurface of the flange portion 186 opposing the ambient water pressure acting on the outside of the valve at the diaphragm 195 and manual activation button 192. By virtue of the cylindrical portion 176 of the valve body 170, and the central passage 181 and apertures 183 of the weight member 180, the pressure within the helmet is directly communicated to the chamber 202, and if the helmet pressure falls below predetermined limits, or if the manual activation button is pressed by the diver, the valve will close such that the sloping surface 205 of weight 180 will bear against sloping surface 206 of seal member 178, and the sharp edge portion 187 will bear against a main seal 208. This closed position is illustrated in FIG. 12B which additionally shows first chamber 211 distinctly sealed off from second chamber 212.

The complementary sloping surface 205 and 206 allow a sliding engagement of weight 180 and seal 178 so that the stroke of weight 180 is no way impaired. A positive and tight seal is thus insured both by seal 178 and main seal 208. The fail-safe valve is constructed and arranged such that the pressure differential will maintain the valve in a closed position even if the exhaust control valve which caused the closing were to resume normal operation.

Figure 13:
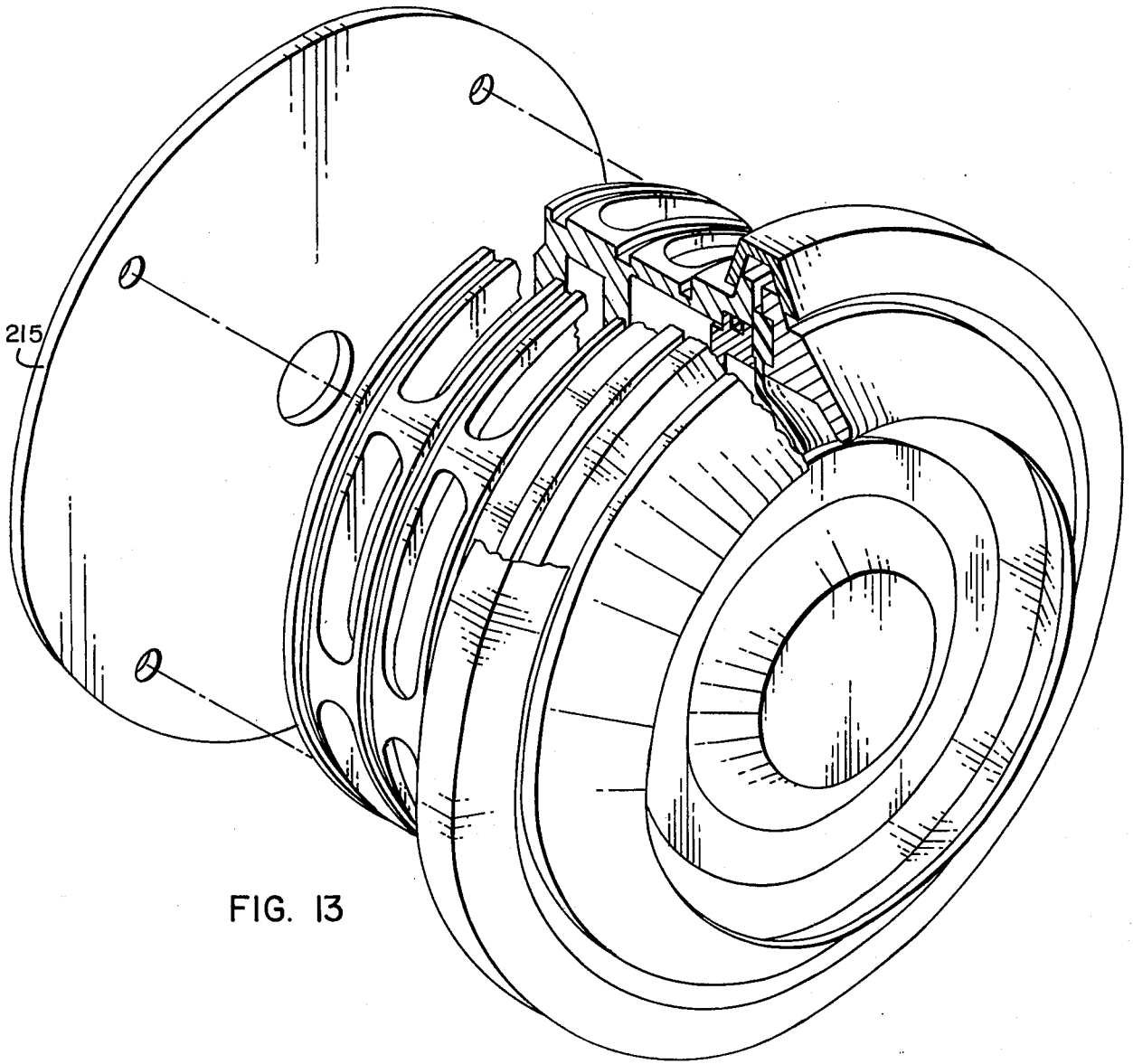
FIG. 13 is an isometric view of the valve of FIG. 12A.

For insertion into the receiver of the helmet, the valve includes the normally provided O-rings and an isometric view of the valve is illustrated in FIG. 13, which additionally shows a securing plate 215. In a perferred embodiment, the helmet system is constructed and arranged such that when the fail-safe valve and exhaust control valve are inserted into their respective receivers, the central axes of the valves will be colinear. Other arrangements, however, are possible such as the exhaust control valve and fail-safe valve axes being at an angle with respect to one another other than 180°, and in some construction the two valves may be incorporated into a unitary body, in which case the interconnecting duct 45 would be eliminated.

What is claimed is:

1. Underwater breathing apparatus comprising:

A. diver headgear including an input connection means for receiving breathing gas from a remote source and an output connection means for returning exhaust gas back to said source;

B. an exhaust flow path connected to said output connection means and including a normally open fail-safe valve and an exhaust control valve in series arrangement, with each said valve including three compartments;

C. said exhaust flow path including a first duct communicating the interior space for said headgear with a first compartment of said fail-safe valve;

D. a second compartment of said fail safe valve being directly communicative with a first compartment of said exhaust control valve;

E. a second compartment of said exhaust control valve being directly communicative with said output connection means;

F. said first compartment of said respective valves being communicative with said second compartment of said respective valves;

G. the third compartment of each said valve being out of said flow path and being in direct pressure communication with said interior space for sensing the pressure therein;

H. said third compartment of said fail-safe valve including means responsive to the pressure in said interior space relative to the ambient water pressure at said fail safe-valve and operable to prevent flow from said first compartment to said second compartment of said fail-safe valve when the pressure in said interior space falls below predetermined limits relative to the ambient water pressure at said fail-safe valve;

said third compartment of said exhaust control valve including means responsive to the pressure in said interior space relative to the ambient water pressure at said exhaust control valve and thereby, operable to control flow from said first compartment to said second compartment of said exhaust control valve and maintain the pressure in said interior space within said predetermined limits relative to the ambient water pressure at said exhaust control valve.

2. Apparatus according to claim 1 wherein:

A. said headgear is a diver worn helmet.

3. Apparatus according to claim 2 wherein:

A. said fail-safe valve is constructed and arranged to actuate when the helmet pressure falls below predetermined limits relative to the ambient water pressure at said fail-safe valve.

4. Apparatus according to claim 2 wherein said helmet includes:

A. an overpressure valve operable to maintain helmet pressure at a predetermined value in the event of fail-safe valve actuation.

5. Apparatus according to claim 2 wherein:

A. said valves are mounted on said helmet at spaced apart locations.

6. Apparatus according to claim 5 which includes:

A. an interconnecting duct, interconnecting like compartments of said fail-safe and exhaust control valves.

7. Apparatus according to claim 5 wherein:

A. each said valve includes a central axis;

B. said valves being mounted on said helmet such that the central axis of one said valve is colinear with the central axis of the other said valve.

8. Apparatus according to claim 1 wherein:

A. said exhaust control valve includes a weighting means such that the activation of said valve is a function of diver orientation.

9. Apparatus according to claim 1 wherein:

A. said fail-safe valve includes a weighting means such that the activation of said valve is a function of diver orientation.

10. Apparatus according to claim 1 which includes:

A. a one way check valve in the supply between said source of said headgear;

B. said check valve being the only valving means between said source and the diver, on the supply side.

11. Apparatus according to claim 10 wherein:

A. said damping means includes a plurality of tubes.

12. Apparatus according to claim 1 which includes:

A. a vent defining a communicative passage between said third compartment of said exhaust control valve and said interior space;

B. damping means within said passage to prevent valve oscillation.

13. Underwater breathing apparatus comprising:

A. a diving helmet including an input connection means for receiving breathing gas under pressure, from a remote source, and an output connection means for returning exhaust gas back to said source;

B. a normally-open fail-safe valve and an exhaust control valve in series arrangement, each of said valves including an input and an output and means for controlling flow therethrough;

C. a first conduit, connecting said input of said fail-safe valve with the interior of said helmet, for collecting exhaust gas;

D. a second conduit connecting said output of said fail-safe valve with said input of said exhaust control valve;

E. said exhaust control valve being connected to said output connection means;

F. each of said valves including means operably associated with said means for controlling flow through said valves for sensing the difference between said ambient water pressure and said helmet pressure directly as opposed to the pressure within said conduits;

G. said means for controlling flow of said normally open fail-safe valve being operable, responsive to said sensing means, for preventing flow through said fail-safe valve if the pressure within said helmet falls below predetermined limits relative to the ambient water pressure at said fail-safe valve;

H. said means for controlling flow of said exhaust control valve being operable, responsive to said sensing means for controlling flow through said exhaust control valve to maintain helmet pressure within said predetermined limits relative to the ambient water pressure at said exhaust control valve.

* * * * *